US009353491B2

(12) United States Patent
Wachsmann

(10) Patent No.: US 9,353,491 B2
(45) Date of Patent: May 31, 2016

(54) EJECTOR FOR A MOBILE GROUND PREPARATION MACHINE

(71) Applicant: BOMAG GmbH, Boppard (DE)

(72) Inventor: Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 161 days.

(21) Appl. No.: 13/920,399

(22) Filed: Jun. 18, 2013

(65) Prior Publication Data

US 2013/0334865 A1 Dec. 19, 2013

(30) Foreign Application Priority Data

Jun. 19, 2012 (DE) ..... 10 2012 012 615

(51) Int. Cl.
*E21C 35/18* (2006.01)
*E01C 23/088* (2006.01)

(52) U.S. Cl.
CPC ..... *E01C 23/088* (2013.01)

(58) Field of Classification Search
CPC ..... E01C 23/088
USPC ..... 404/90–94; 299/100–113, 36.1, 299/39.1–39.8; 241/294; 37/267; 172/701.3, 702–704
See application file for complete search history.

(56) References Cited

U.S. PATENT DOCUMENTS 4,886,009 A * 12/1989 Gondar ..... B23D 51/025 116/208
6,619,756 B1 * 9/2003 Holl et al. ..... 299/85.2
2005/0098331 A1 * 5/2005 Edwards ..... 172/701.3
2010/0244544 A1 * 9/2010 Buhr et al. ..... 299/64
2011/0296687 A1 * 12/2011 Hebuterne et al. ..... 29/889.71

FOREIGN PATENT DOCUMENTS

DE 10 2009 014 729 B3 11/2010
WO 2010/108760 A1 9/2010

OTHER PUBLICATIONS

Espacenet, English Machine Translation of Application No. DE102009014729B3, published Nov. 4, 2010, retrieved from http://worldwide.espacenet.com on Jun. 14, 2013 (11 pages).
German Patent Office, Search Report of Application No. 10 2012 012 615.8, mailed Jan. 25, 2013 (5 pages).

* cited by examiner

*Primary Examiner* — Sunil Singh
(74) *Attorney, Agent, or Firm* — Wood, Herron & Evans, LLP

(57) ABSTRACT

Described is an ejector unit for a milling drum of a mobile ground preparation machine comprising a discharge side and a reverse side that is opposite to the discharge side. It comprises a basic unit on the drum and an ejector plate, which is held on the basic unit by means of screw-threaded bolts. There is a positive fit between the basic unit and the ejector plate, which positive fit involves at least one pin, on the one hand, and at least one complementary cylindrical counterbore on the other hand, whereby the at least one pin and the at least one ejector are oriented so as to be coaxial to the longitudinal axis of the screw-threaded bolts. Preferably, a shoulder is also provided along the base of the basic unit on its side facing the ejector plate, and the ejector plate has at least one complementary shoulder, whereby the shoulder on the basic unit and the at least one shoulder on the plate have meshing regions, which in the mounted state prevent transverse displacements in three directions.

12 Claims, 12 Drawing Sheets

EJECTOR FOR A MOBILE GROUND PREPARATION MACHINE

CROSS-REFERENCE TO RELATED APPLICATIONS

The present application claims priority under 35 U.S.C. §119 of German Patent Application No. 10 2012 012 615.8, filed Jun. 19, 2012, the disclosure of which is hereby incorporated herein by reference in its entirety.

FIELD OF THE INVENTION

The present invention relates to an ejector unit for a milling drum of a mobile ground preparation machine, which ejector unit comprises a basic unit on the drum side and a replaceable ejector plate having a discharge side and a reverse side located opposite to the discharge side and that is removably attached to the basic unit by means of bolts.

BACKGROUND OF THE INVENTION

Mobile ground preparation machines of this type are cold milling machines, stabilizers, surface miners, and recyclers, in particular, which are used in the construction of paved traffic areas and are included below in the term "ground milling machines". The working implements consist of a milling drum that is provided with a plurality of cutting tools, more particularly milling bits. The cutting tools are usually disposed along spiral lines on the surface of the milling drum, which spiral lines correspond to a left-hand thread on one half of the milling drum and to a right-hand thread on the other half of the same. As a result of this orientation of the spiral lines, material that has been milled off is conveyed inwardly to the center region of the milling drum, in the case of cold milling machines and surface miners, due to the rotation of the drum. The ejector units are disposed in this region and are distributed over the periphery of the milling drum such that the milled material is flung out away from the drum and "shoveled" by means of the ejector units onto a conveyor belt for removal from the milling site. In the case of stabilizers and recyclers, the ejector plates are used for mixing the milled material. The ejector plates are subjected to attrition forces and must therefore be replaced regularly. A milling drum comprising ejector units of this type is described in DE 102009014729 B3, for example.

For reasons of weight optimization and cost, efforts are made towards providing the ejector plate with the least possible material thickness. The problem frequently encountered in the use of these light-weight ejector plates is that they become deformed and wear out under stress conditions, which restricts their operability. One particular problem in this respect relates to the region in which the ejector plates are attached to the basic unit and in which the material is weakened, for example, by holes provided for a bolted connection. However, any deformation of the material is in this region particularly undesirable, since a deformed ejector is difficult to remove from the basic unit for the purpose of replacement.

A further problem relates to the widespread use of ejector plates not made by the original manufacturer, which have insufficient strength properties as a replacement part.

SUMMARY OF THE INVENTION

It is an object of the present invention to provide an ejector unit of the above type in which the ejector plate can be removably attached to the milling drum in a particularly stable and secure manner.

This object is achieved by providing a positive fit between the basic unit and the ejector plate, which positive fit comprises at least one pin on the basic unit, on the one hand, and at least one complementary counterbore on the counterpiece, on the other hand, wherein the at least one complementary counterbore is in the form of a widening of the bolt hole in the positive fit in question on the respective counterpiece, and the at least one pin and the at least one counterbore are oriented so as to be coaxial to the longitudinal axis of the bolt.

It is particularly advantageous when the at least one pin is in the form of a sector of a hollow pin surrounding the bolt hole.

In a preferred embodiment of the present invention, the at least one pin is in the form of a hollow cylinder and the at least one counterbore is in the form of a cylindrically hollow recess. The hollow cylinder can be of a symmetrical annular cross-section or an eccentric cross-section in which the external wall is shaped eccentrically and the internal wall has an annular shape. The eccentricity can consist in one or more bulges or one or more indentations in the external cylinder wall.

It has been found to be advantageous when the at least one pin consists of a first hollow cylinder segment on the basic unit, and when a second hollow cylinder segment is provided on the ejector plate that is angularly offset relatively to the first hollow cylinder segment with respect to the longitudinal axis of the bolt in such a way that the hollow cylinder segments on the basic unit and the ejector plate complement each other to form a hollow body, preferably a complete hollow cylinder.

Preferably, there is provided, between the basic unit and the reverse side of the ejector plate, a positive fit consisting of complementary parts shaped according to the key/lock principle, such that the basic unit and the ejector plate can be joined together only when a matched pair of shaped parts as predefined according to the key/lock principle is present. The shape and disposition of the complementary shaped parts characterize the type and properties of the respective ejector plate, so that incorrect ejector plates cannot be installed. There is thus the assurance that the quality criteria specified by the manufacturer are observed when the ejector plate is replaced.

It is particularly advantageous when two bolt openings comprising hollow pins and counterbores are provided at a distance from each other and when the hollow pins and the counterbores are disposed symmetrically in relation both to the longitudinal center axis and to the width center axis of the ejector plate.

In a further advantageous development of the present invention, a shoulder is provided along the base of the basic unit on that side of the basic unit which faces the ejector plate, the ejector plate comprises at least one complementary shoulder, and the shoulder disposed on the basic unit and the at least one shoulder disposed on the ejector plate comprise interlocking regions that prevent any transverse displacement of the ejector plate in three directions after it has been attached to the basic unit.

It is also advantageous when the shoulders disposed on the basic unit and on the ejector plate are shaped according to the key/lock principle so that it is only possible to assemble the basic unit and the ejector plate when a matched pair of shaped parts predefined by the key/lock principle is used.

In a further advantageous embodiment, two mirror-reversed shoulders are provided on the ejector plate that are oriented in opposite directions and that extend in a rotationally symmetrical manner relatively to the point of intersection of the longitudinal center axis and the width center axis, such that the ejector plate can be joined to the basic unit selectively by way of one or other of the shoulders. This embodiment makes it possible to attach the ejector plate to the basic unit also following rotation of the ejector plate through 180°, so that use may be made of the longitudinal edges of both opposing long sides of the ejector plate.

Preferably, the complementary shaped parts are designed in such a way that corresponding projections and raised regions of the basic unit and the ejector plate are disposed at those locations where they assist in increasing the stability of the ejector plate.

The shoulders are provided, for example, with a wavy shape. Wave crests on one portion of the ejector unit, for example, the ejector plate, will rest against wave troughs disposed on the other component, that is to say, the basic unit. This construction makes it possible to support the mounted ejector plate on the front end of the basic unit and also to prevent the ejector plate from being displaced along the basic unit, with the result that there is an increase in stability. Furthermore, this prevents the attachment of ejector plates that do not comprise the wavy profile and are possibly unsuitable.

A particularly satisfactory fit of the ejector plate on the basic unit is achieved by providing a receded region in at least one of the mutually facing surfaces of the basic unit and the ejector plate along the width center axis so that two lateral contact surfaces that are spaced from the width center axis and are raised in relation to the receded region are formed between the basic unit and the reverse side of the ejector plate. Preferably, the reverse side of the ejector plate comprises, on each lateral half, a raised contact surface located at a distance from the width center axis for resting against the basic unit and a receded region located between the contact surfaces so that the reverse side of the ejector plate does not rest against the basic unit in the receded region. Thus, since the ejector plate is not supported against the basic unit centrally, but instead by means of two lateral supports, the ejector plate is prevented from tilting and tipping over. Alternatively or additionally, the basic unit can be provided with a corresponding receded center region that prevents the ejector plate from resting against the center region of the basic unit.

According to a further embodiment, at least one attrition indicator mark is provided on the discharge surface of the ejector plate. The attrition indicator mark makes it possible to readily monitor the degree of wear on the discharge surface and to arrange for a timely replacement of the ejector before its cross-section is weakened excessively by abrasion. The attrition indicator mark is in the form of a groove, for example. For example, if the bottom of the groove is no longer discernible, the ejector unit has reached its attrition limit. Likewise, a residual depth of the groove can be defined for determination of the attrition limit. The groove can also be filled with a second material that differs optically from the basic material of the ejector and is, for example, lighter or darker in color. The groove filled with the second material is then visible, while the milled ground material will not readily settle therein.

BRIEF DESCRIPTION OF THE DRAWINGS

The present invention is explained below in more detail on the basis of exemplary embodiments and with reference to the attached figures of the drawings. In the diagrammatic drawings.

Like components in the various embodiments are provided with like reference numerals.

DETAILED DESCRIPTION OF THE INVENTION

Figure 1:
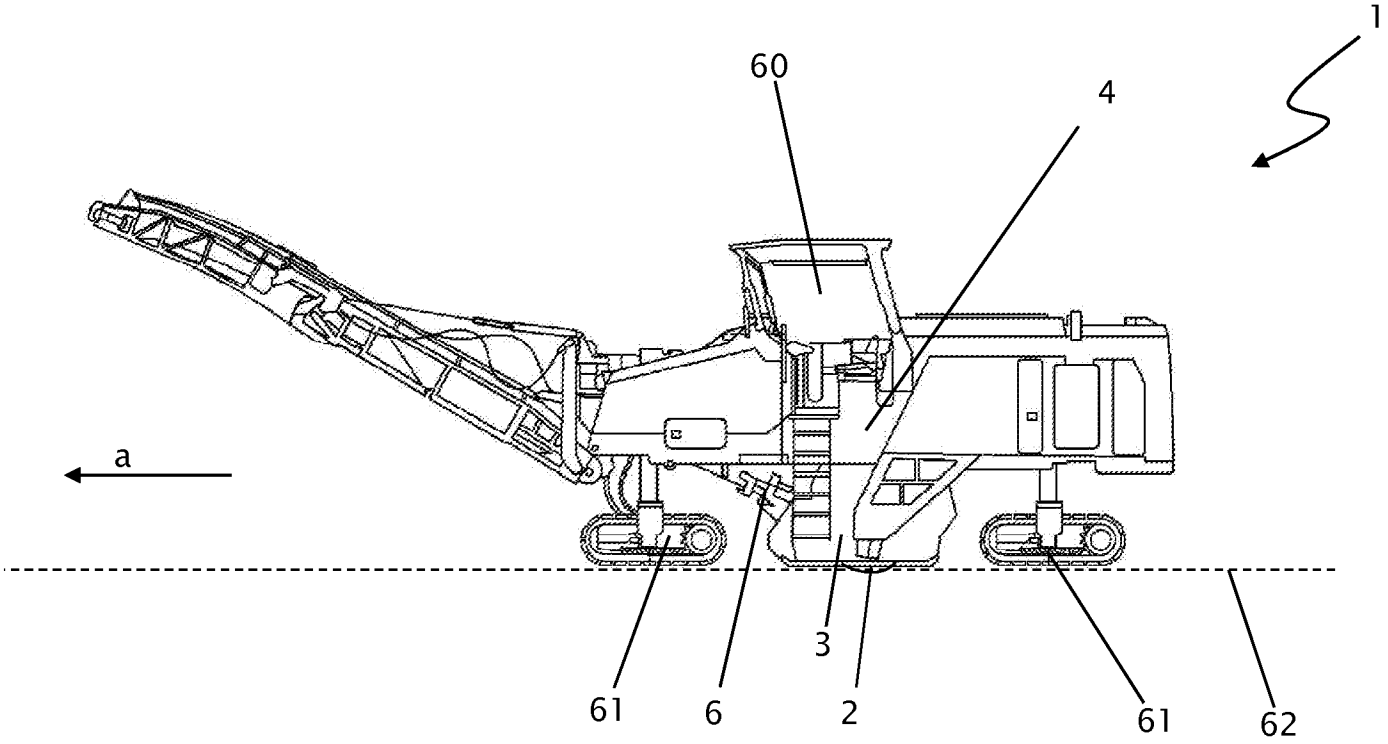
FIG. 1 is a side view of a ground preparation machine in the form of a ground milling machine of the front loading type comprising a central milling drum.

FIG. 1 shows a ground milling machine 1 of the front loading type comprising a centrally disposed milling drum 2 located in a drum housing 3. The working direction (forward direction) is denoted by the arrow 'a'. The ground milling machine 1 further comprises a machine frame 4 comprising a control platform 60 and crawler tracks 61 mounted on the machine frame 4 by means of lifting columns so as to be vertically adjustable (it being also possible to use wheeled undercarriages here as an alternative).

In the operating mode, the ground milling machine 1 travels on the ground 62 in the machine direction 'a' and, in doing so, mills off ground material from the ground 62 by means of the milling drum 2 having been set in rotation. As a result of the rotation of the milling drum 2, the milled material is flung from the drum housing 3 onto a conveyor belt 6, which communicates with the drum housing 3, for removal of said material.

Figure 2:
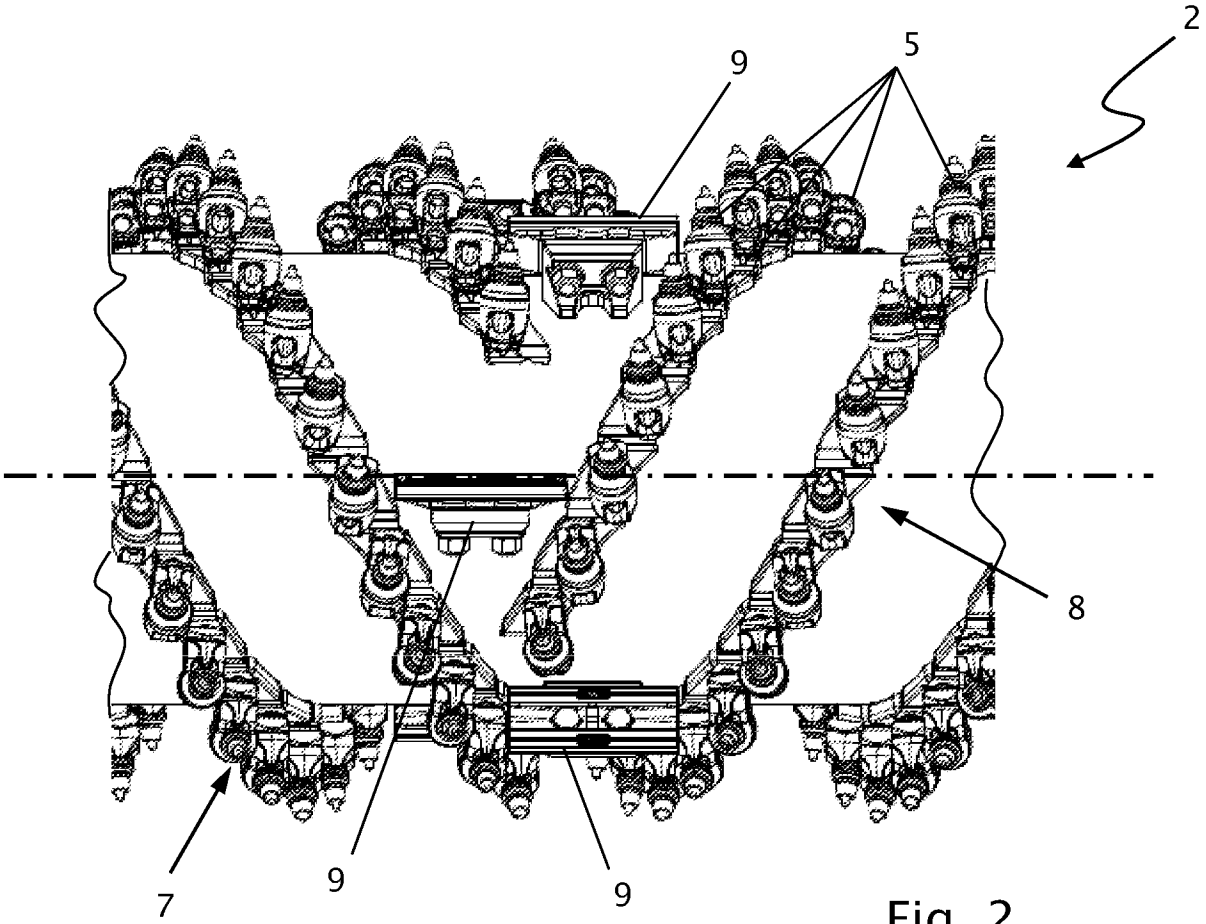
FIG. 2 is a partial side view of a milling drum.

As shown in FIG. 2, a plurality of cutting tools 5 in the form of milling bits are attached to the surface of the milling drum 2. They are disposed along two spirals 7, 8 that extend in different directions and meet at the center of the milling drum 2 to form V-shaped regions. The cutting tools 5 disposed along mutually converging spirals 7, 8 cause the milled material to be transported from the outside to the inside when the milling drum 2 rotates. In the V-shaped regions there are attached ejector units 9, which are in the form of vanes protruding in the radial direction and that fling the milled material outwardly so as to be collected by the conveyor belt.

Figure 3:
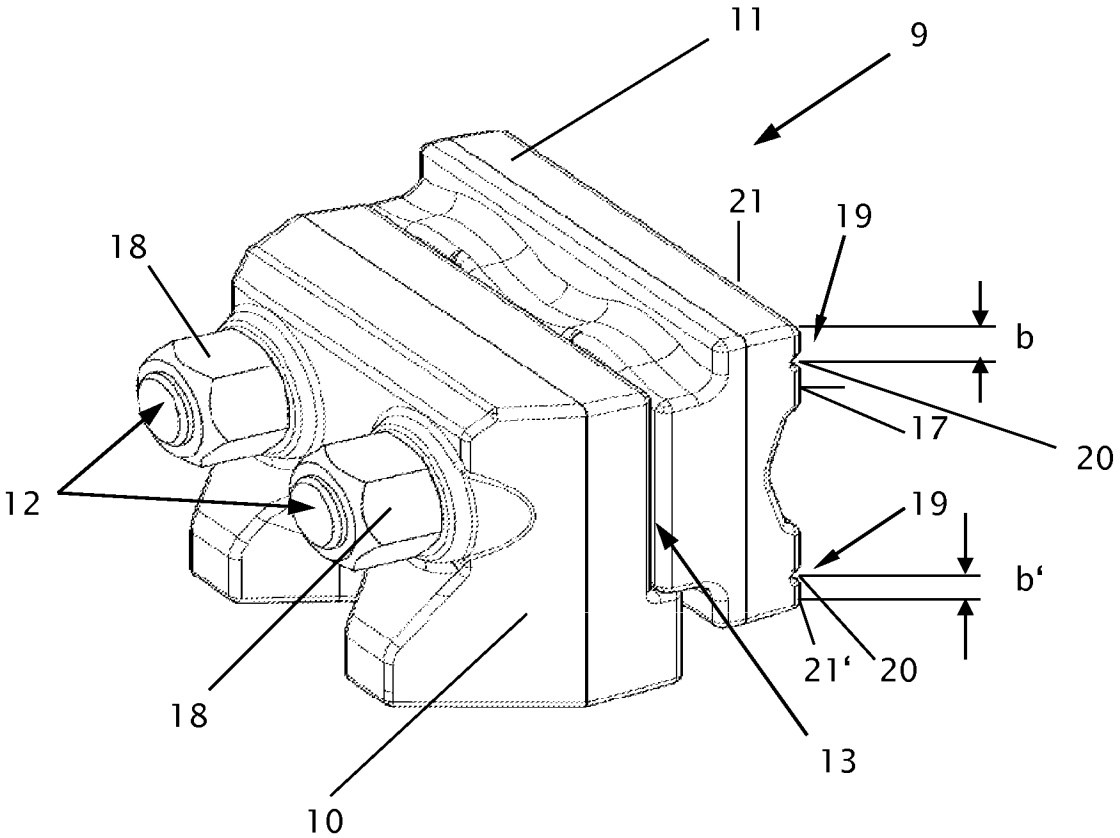
FIG. 3 is a perspective rear view of an ejector unit according to a first exemplary embodiment.
Figure 4:
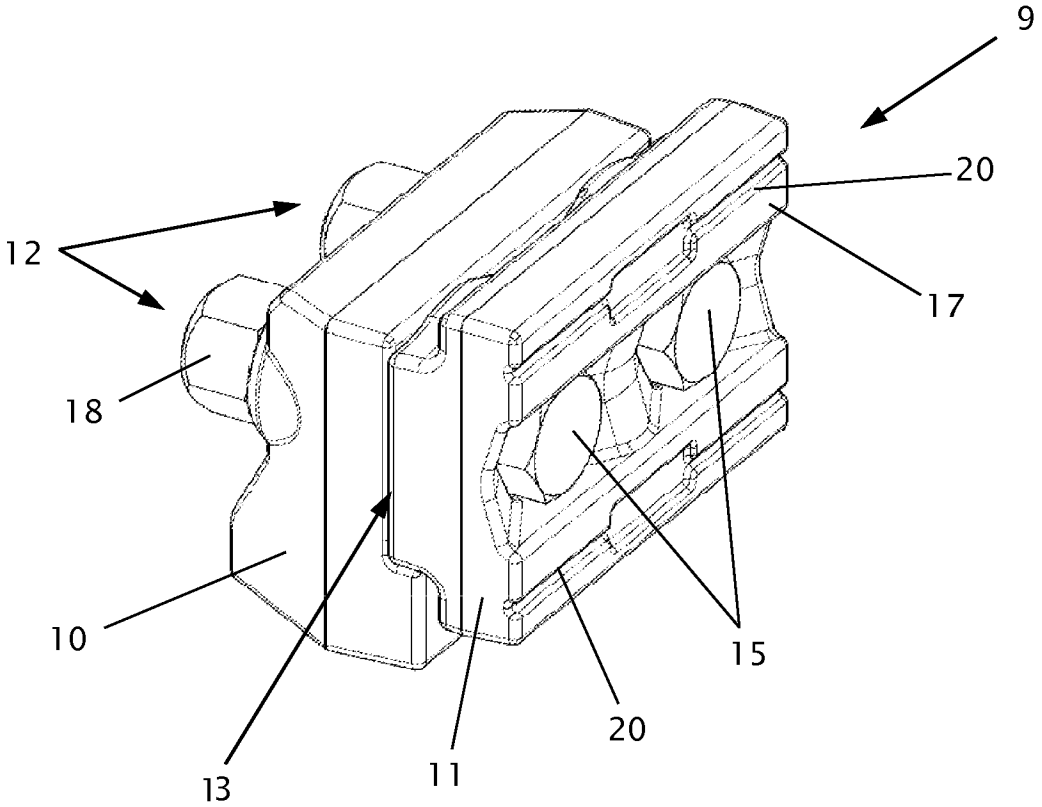
FIG. 4 shows the ejector unit as shown in FIG. 3 in a perspective view of the discharge side.
Figure 5:
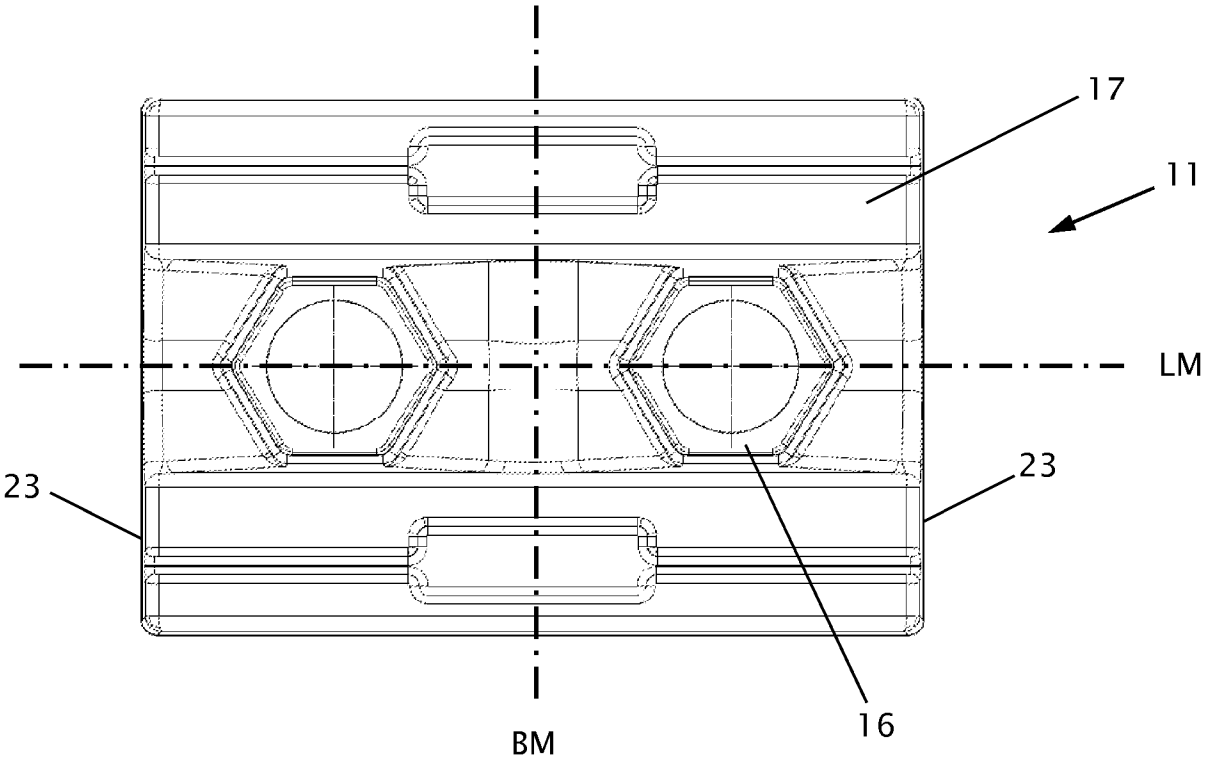
FIG. 5 is a top view of the discharge side of an ejector plate of the ejector unit as shown in FIGS. 3 and 4.

The ejector units 9, as shown in FIG. 3 and FIG. 4, are composed of a basic unit 10 and an ejector plate 11, which basic unit 10 is fix-welded to the surface of the milling drum 2 and the ejector plate 11 is removably attached to the basic unit by means of two parallel bolted joints 12. The screw-threaded bolts 14 extend approximately tangentially to the cylindrical surface of the milling drum 2, and the bolt heads 15 rest in recesses 16 on the discharge side 17 of the ejector plate 11 so as to be flush with the surface of the ejector plate 11 and locked against rotation. For the purpose of preventing the bolts from rotating, the recesses 16 are in the form of blind bores comprising sidewalls shaped such that they complement the bolt heads 15, which are in this case shaped hexagonally, as shown in FIG. 5. The bolts 14 are secured on the reverse side of the basic unit 10 by means of nuts 18. FIG. 5 further shows that the ejector plates 11 are rotationally symmetric with respect to the point of intersection of their longitudinal axis LM, which in the mounted state of the ejector plates extends parallel to the rotation axis of the milling drum 2 in the exemplary embodiment shown, with their width center axis BM, which is oriented approximately in the radial direction of the milling drum 2. Therefore, the ejector plates 11 can be used in two operating positions in which they are screwed to the basic unit 10, i.e., before and after having been rotated through 180°.

Furthermore, there is a positive fit 13 between the basic unit 10 and the ejector plate 11 according to the key/lock principle. The key/lock principle governing the positive fit 13 ensures that only factory-approved ejector plates 11 can be positioned in an operative manner on the basic unit. Thus, if the ejector plate 11 does not have a shape that is complementary to the form and/or configuration of the basic unit 10, it cannot be attached to the basic unit 10. The shapes defining the positive fit 13 are formed on the reverse side of the ejector plate 11 and on the counterpiece of the basic unit 10.

On the discharge side 17 of the ejector plates 11 there are provided attrition indicators 19 in the form of indentations in the surface of the discharge side. In the exemplary embodiment shown, the attrition indicators 19 are in the form of linear grooves 20, which are each provided at a predefined distance b, b' from each of the two working edges 21, 21' of the ejector plate 11 respectively and which are parallel to said working edges 21, 21' over the entire width of the ejector plate 11, and which indicate the attrition limits. The term "working edge 21, 21'" refers to the edge that protrudes freely outwardly approximately in the radial direction in the mounted state of the ejector plates 11 and that is therefore subjected to the greatest degree of attrition during ejection of the milled material. Due to its symmetrical design, each ejector plate 11 comprises two opposing working edges 21, 21'. The maximum permissible attrition has been reached when the material of the working edge 21 has worn off as far as the attrition indicator 19. It is then necessary to replace the ejector plate 11, which can alternatively be replaced by rotating the ejector plate 11 through 180° and mounting the same such that its working edge 21' not yet been worn off points outwardly.

Figure 6:
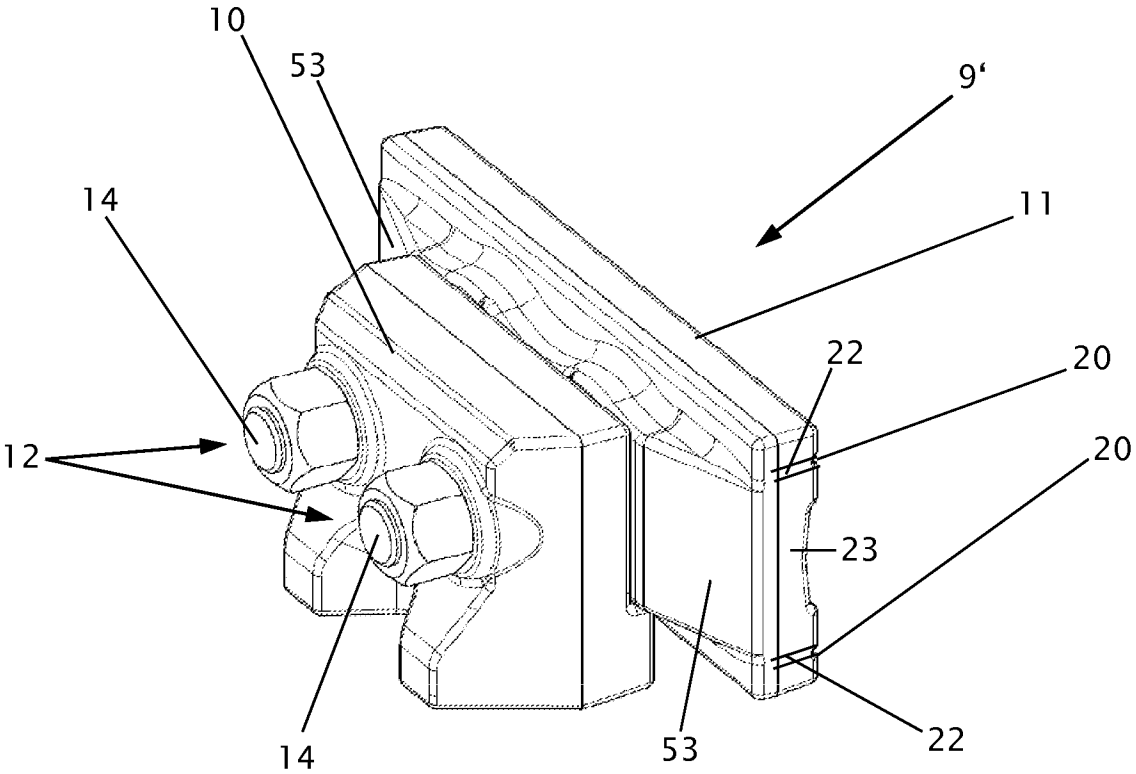
FIG. 6 is a perspective rear view of a second exemplary embodiment of an ejector unit.

Additional attrition indicators of this kind can also be provided across the narrow sides 23 of the discharge side 17 as shown in FIG. 6. FIG. 6 shows a second exemplary embodiment of an ejector unit 9' in which the grooves 22 are also provided on the narrow sides 23 of the ejector plate 11 for the purpose of marking the attrition limit. In the exemplary embodiment illustrated in FIG. 6 there is mounted on a basic unit 10 an ejector plate 11 that is of a greater width than the ejector plate as shown in FIGS. 4 and 5 and that thus has a protrusion 53 extending beyond the basic unit 10 on both sides thereof.

Figure 7:
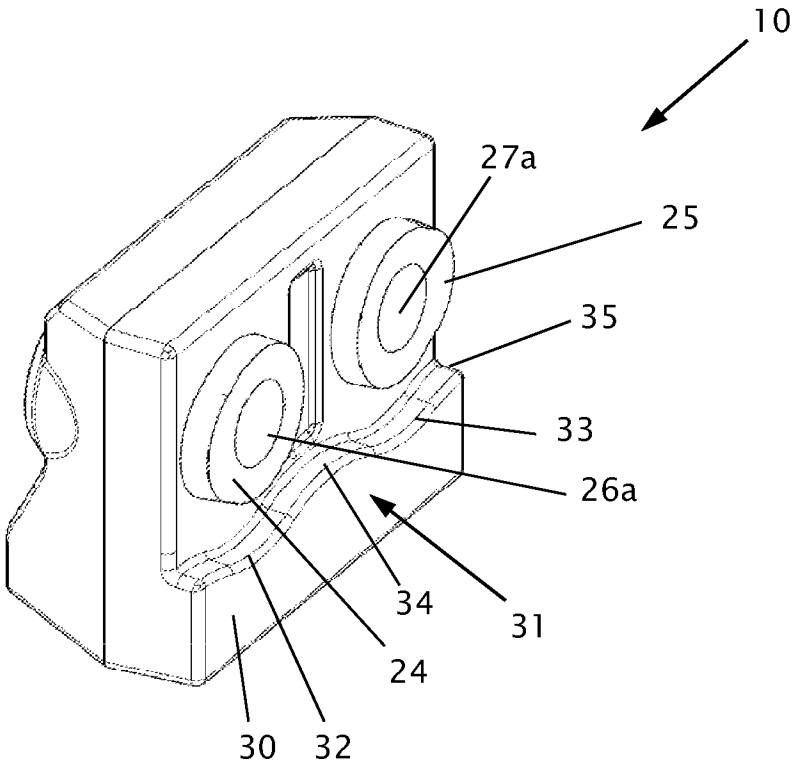
FIG. 7 is a perspective front view of a basic unit of the ejector unit according to a first embodiment.
Figure 8:
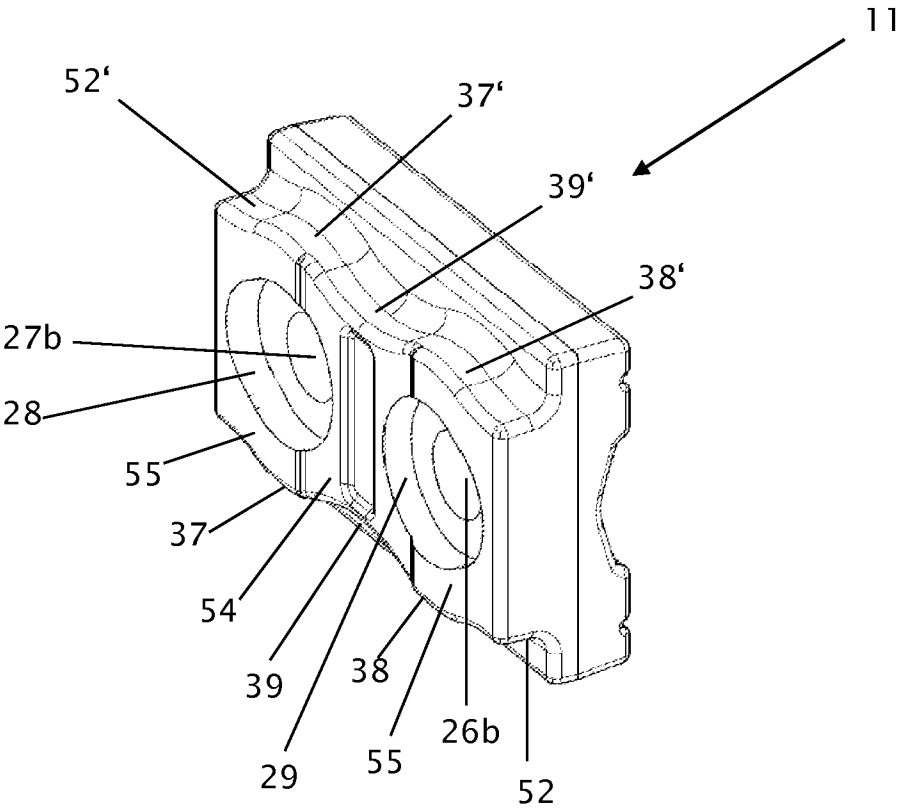
FIG. 8 is a perspective rear view of the ejector plate suitable for the basic unit as shown in FIG. 7.

In a first embodiment of the basic unit 10 and the ejector plate as shown in FIGS. 7 and 8, the positive fit is provided on the basic unit side by two identical pins 24, in the form of circular hollow cylinders fitted around the bolt holes 26*a*, 27*a*. On the side of the ejector plate 11, the positive fit is provided by complementary cylindrical counterbores 28, 29 surrounding the bolt holes 26*b*, 27*b*. When the ejector plate 11 and the basic unit 10 are joined together, this positive fit prevents any transverse and vertical displacements of the ejector plate 11 relatively to the basic unit 10. Furthermore, the large region of engagement between the ejector plate 11 and the basic unit 10 tends to prevent deformation of the ejector plate.

The positive fit further comprises a shoulder 30 that is located on the basic unit and that is raised from that edge of the basic unit 10 which faces the milling drum along the entire width of the basic unit 10. The width of the shoulder 30 is approximately equal to the height of the pins 24, 25. The shoulder is provided with a three-dimensional profile that is, in this case, in the form of a symmetrical wavy contour 31 adapted to effect interlocking of the basic unit 10 and the ejector plate 11. In the exemplary embodiment shown, the symmetrical wavy contour comprises two lateral wave troughs 32, 33 located opposite to the two pins 24, 25, and a centrally located wave crest 34. The wave crest 34 extends towards the space between the pins 24, 25. The wavy contour 31 rises towards the side edges of the ejector plate 11. As a result of the material reinforcement provided by the shoulder 30, the base of the basic unit 10 is broader and more stable and thus contributes to stabilization of the ejector unit.

As shown in FIG. 8, two diametrically opposed shoulders 52, 52' are provided on the reverse side of the ejector plate 11 along its two long sides and in a rotationally symmetric manner relative to the point of intersection of the longitudinal center axis LM and the width center axis BM, which two diametrically opposed shoulders 52, 52' are complementary to the shoulder 30 located on the basic unit. Thus the wavy contours 36 each comprise two wave crests 37, 38 and 37', 38' and a wave trough 39, 39' respectively. The wave crests 37, 38; 37', 38' are located in the region of the counterbores 28, 29. The wave troughs 39, 39' extend towards the space between the counterbores 28, 29. The rotationally symmetrical shape of the components of the positive fit 13 makes it possible for the ejector plate 11 to be attached to the basic unit 10 in two operating positions, as described above.

When the basic unit 10 and the ejector plate 11 are fitted together, the wave crests and wave troughs of the basic unit 10 and of the ejector plate 11 interlock so that the ejector plate 11 is supported on the basic unit 10 in several directions.

As FIG. 8 further shows, a receded region 54 is provided on the reverse side of the ejector plate 11 facing the basic unit 10 along the width center axis BM so that two lateral contact surfaces 55, 56 are formed which are located at a distance from the width center axis BM and by means of which the ejector plate 11 rests flat against the basic unit 10 (FIG. 7).

Figure 9:
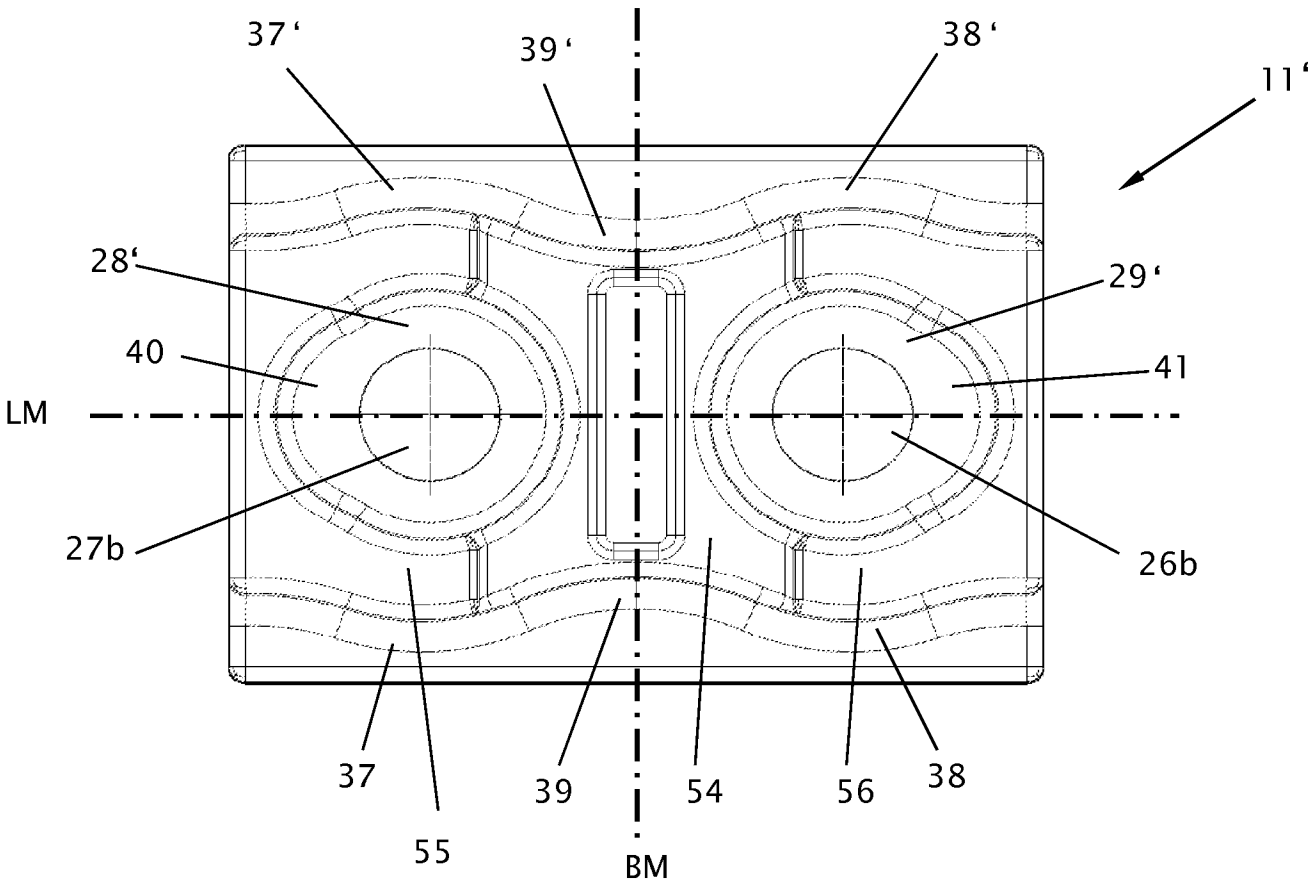
FIG. 9 is a perspective rear view of an ejector plate of a second embodiment.
Figure 10:
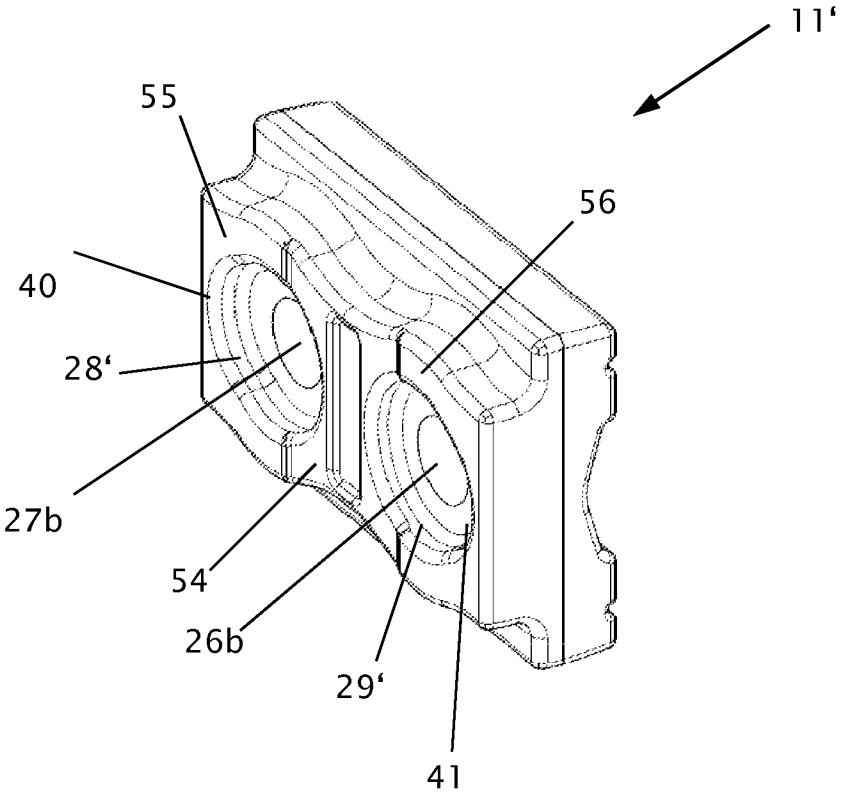
FIG. 10 is a top view of the reverse side of the ejector plate as shown in FIG. 9.

An alternative, second exemplary embodiment of an ejector plate 11' is shown in FIG. 9 and FIG. 10 and comprises counterbores 28,' 29' having an eccentric outer contour instead of cylindrical counterbores as in the case of the first exemplary embodiment. In the exemplary embodiment shown, eccentricity accompanied by rotational symmetry relative to the point of intersection of the longitudinal center axis LM and the width center axis BM of the ejector plate 11' are achieved by a bulge 40 and 41 of the otherwise cylindrical counterbores 28', 29' respectively. The bulges 40, 41 have shapes that are mirrored relatively to the width center axis BM.

The complementary pins on the basic unit comprising a cylindrical passageway for the bolts comprise corresponding eccentric bulges (not shown).

Figure 11:
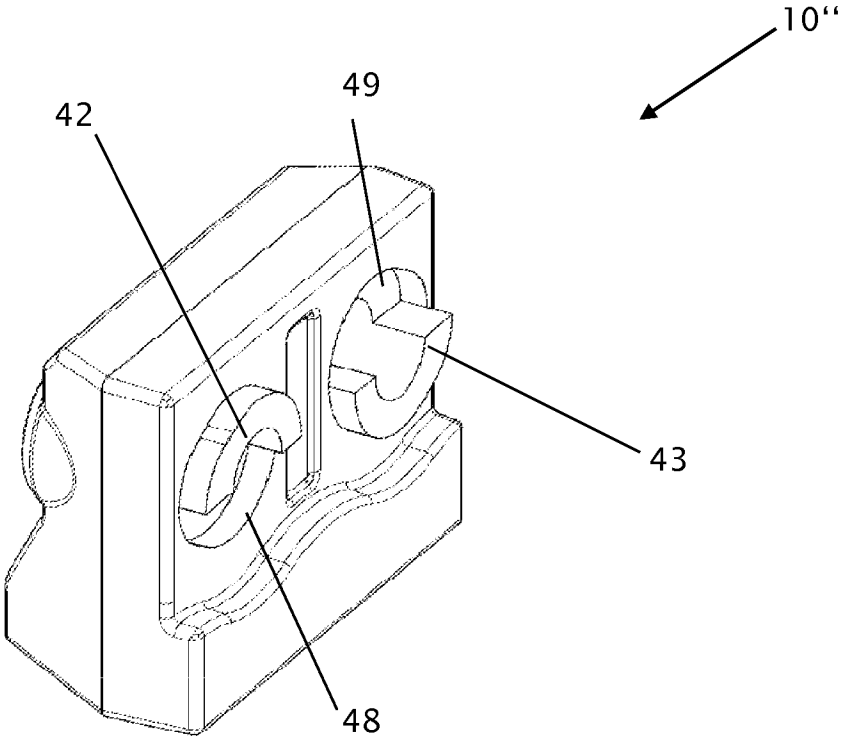
FIG. 11 is a perspective front view of the basic unit according to a third embodiment.
Figure 12:
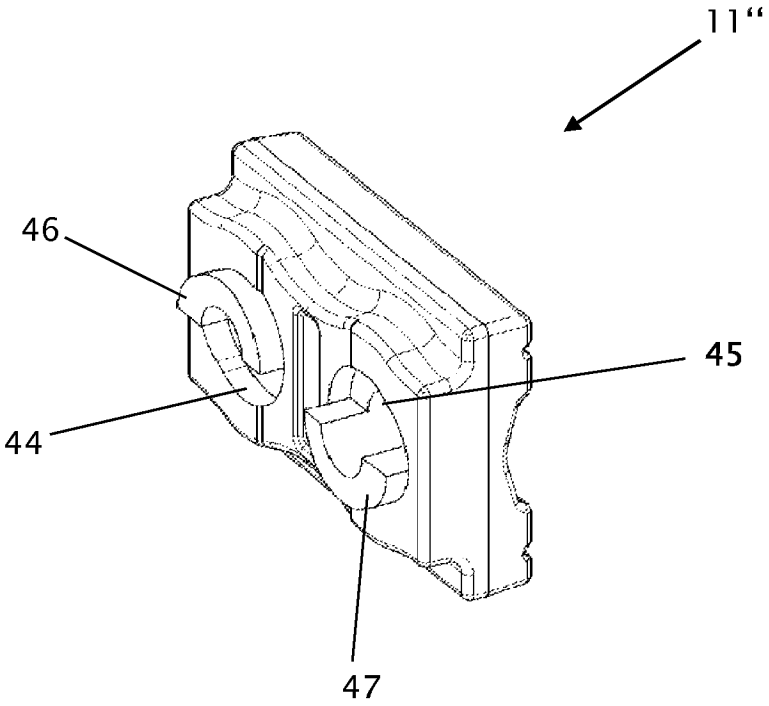
FIG. 12 is a perspective rear view of an ejector plate suitable for the basic unit as shown in FIG. 11.

In the third exemplary embodiment as shown in FIGS. 11 and 12, the pins on the basic unit are in the form of hollow cylinder segments, here in the form of hollow semicylinders 42, 43, and complementary pin segments, here counterbores 44, 45, are provided on the ejector plate 11" in the form of hollow semicylinders. Furthermore, the hollow semicylinders 42, 43 and the complementary counterbores 44, 45 are in mirror-reversed relationship by 180° about the point of intersection of the longitudinal center axis LM and the width center axis BM in the exemplary embodiment shown.

Furthermore, the provision of the above shaped parts, namely, the offset hollow semicylinders and complementary counterbores is repeated in this exemplary embodiment by virtue of the fact that two further offset hollow semicylinders 46, 47 are provided on the reverse side of the ejector plate 11" and two complementary counterbores 48, 49 are provided on the basic unit. The hollow semicylinders 42, 43 on the basic unit and the mutually opposing hollow semicylinders 46, 47 on the ejector plate 11" complement each other to form a complete hollow cylinder. Similarly, the offset counterbores 44, 45 in the ejector plate 11" and the offset counterbores 48, 49 in the basic unit 10" complement each other to form two cylindrically hollow counterbores.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. An ejector unit for a milling drum of a mobile ground preparation machine, comprising:

a basic unit on the drum side; and an ejector plate including a discharge side and a reverse side opposite to said discharge side, said ejector plate being removably attached to said basic unit by at least one screw-threaded bolt, wherein a first positive fit is present between said basic unit and said ejector plate, which first positive fit is formed by at least one pin, on the one hand, and at least one complementary cylindrical counterbore, on the other hand, whereby the at least one complementary cylindrical counterbore is in the form of an enlargement of at least one bolt hole, and whereby said at least one pin and said at least one cylindrical counterbore are oriented so as to be coaxial to a longitudinal axis of said at least one screw-threaded bolt, and further wherein said at least one pin is in the form of a first hollow cylinder segment on said basic unit, and further wherein a second hollow cylinder segment is present on said ejector plate and is angularly offset from said first hollow cylinder segment with regard to the longitudinal axes of the at least one bolt, such that said hollow cylinder segment on said basic unit and said hollow cylinder segment on said plate are complementary to each other to form a hollow body.

2. The ejector unit according to claim 1, wherein said at least one pin is in the form of a sector of a hollow pin surrounding said at least one bolt hole.

3. The ejector unit according to claim 1, wherein said at least one pin is in the form of a hollow cylinder and said at least one cylindrical counterbore is in the form of a hollow cylindrical recess.

4. The ejector unit according to claim 1, wherein a second positive fit is provided between the basic unit and the reverse side of the ejector plate, the second positive fit comprising complementary parts shaped such that the basic unit and the ejector plate can be joined together only when a matched pair of shaped parts is provided on the basic unit and on the reverse side of the ejector plate in a complementary manner.

5. The ejector unit according to claim 1, further comprising two spaced bolt holes, a pair of pins and a pair of cylindrical counterbores, said pair of pins and said pair of cylindrical counterbores being rotationally symmetrical with respect to a point of intersection of a longitudinal center axis (LM) and a width center axis (BM).

6. The ejector unit as defined in claim 1, wherein a shoulder is present along a base of said basic unit on a side thereof that faces the ejector plate, and the ejector plate has at least one complementary shoulder, said shoulder on the basic unit and said at least one shoulder on the ejector plate exhibit meshing regions, which in a fitted state, prevent transverse displacements in three directions.

7. The ejector unit according to claim 6, wherein said shoulder on said basic unit and said at least one shoulder on said ejector plate are configured complementary to one another such that said basic unit and said ejector plate can only be fitted together when said shoulder on said basic unit and said at least one shoulder on said ejector plate match in a complementary manner.

8. The ejector unit according to claim 6, wherein said ejector plate comprises two shoulders which are mirror-reversed so as to be rotationally symmetrical with respect to a point of intersection of a longitudinal center axis (LM) and a longitudinal width axis (LB).

9. The ejector unit according to claim 1, wherein a receded region is provided on the reverse side of the ejector plate facing the basic unit along a width center axis BM so that two lateral contact surfaces are formed which are located at a distance from the width center axis BM.

10. The ejector unit according to claim 1, further comprising:

an attrition indicator which is in the form of a groove provided at a discharge side of the ejector plate and spaced from a working edge of the ejector plate for indicating an attrition limit.

11. The ejector unit according to claim 1, wherein said hollow body comprises a hollow cylinder.

12. A milling drum comprising an ejector unit according to claim 1.

* * * * *